United States Patent [19]

Richards

[11] 4,165,573

[45] Aug. 28, 1979

[54] COIN HOLDER

[76] Inventor: Marjorie S. Richards, 4 Ct. of Fox River Valley, Lincolnshire, Ill. 60015

[21] Appl. No.: 875,216

[22] Filed: Feb. 6, 1978

[51] Int. Cl.[2] ..... G09F 3/18

[52] U.S. Cl. ..... 40/10 D; 206/0.8; 40/1.5; 40/152

[58] Field of Search ..... 206/0.8, 0.81, 0.82, 206/0.83, 0.84; 40/1.5, 27.5, 10 R, 152

[56] References Cited

U.S. PATENT DOCUMENTS

| | | | |
|---|---|---|---|
| 607,104 | 7/1898 | Whiehead | 40/152.1 |
| 3,139,977 | 7/1964 | Burdick | 206/0.82 |
| 3,407,523 | 10/1968 | Winston | 40/1.5 |
| 3,448,850 | 6/1969 | Segel | 206/0.80 |
| 3,624,832 | 11/1971 | Dunn | 206/0.83 |
| 4,063,369 | 12/1977 | Grant | 206/0.82 |

*Primary Examiner*—Louis G. Mancene
*Assistant Examiner*—Wenceslao J. Contreras
*Attorney, Agent, or Firm*—Knechtel, Valentino, Demeur & Dallas

[57] ABSTRACT

A coin holder for removably retaining coins including a decorative backing member having an annular rim whereby the coin is retained. A locking ring is attached to the annular rim. The holding arrangement for the coins permits one to display the coin as a piece of jewelry or to be supported upright on a surface as a picture frame.

6 Claims, No Drawings

COIN HOLDER

This invention relates to a coin holder for interchangeably receiving and displaying respective ones of a plurality of substantially like-size coins.

There are presently on the market numerous commemorative coins, coins depicting special events, coins in a series depicting all of the presidents of the United States, and coins of other similar nature. All of these coins are generally quite valuable and are generally quite attractive. More and more of these coins are being offered for sale, and they are being purchased by people of all walks of life, including collectors.

Generally, in many cases, these coins are merely retained for safe keeping in safe deposit boxes or the like or, alternatively, in many cases they are displayed in specially designed display frames which are adapted for wall mounting or placement on a book shelf or the like. Accordingly, when mounted for display in this fashion, full use and value of the beauty of these coins is not or cannot be utilized. It would therefore be advantageous and desirable to have or to provide additional means or ways to display respective ones of these coins, particularly in an interchangeable fashion. For example, in those cases where there are a series of substantially like-size coins, it would be particularly advantageous to have some means for displaying the respective ones of the coins in an interchangeable fashion, so that the individual ones of the coins could be worn, for example, as a necklace, a broach or the like, or could alternatively, be displayed seated on a bookcase or as a picture on the wall.

The coin holder of the present invention is adapted to interchangeably receive and display respective ones of a number of substantially like-size coins, so that greater advantage can be obtained from the ownership of these coins. In particular, the coin holder of the present invention preferably and advantageously is itself formed from a precious or semi-precious metal, in an attractive design or configuration, such that it can be worn as a piece of jewelry when one of the coins is disposed within it for display. In particular, the coin holder in combination with a chain or the like can be worn as a necklace or, alternatively, a pin can be provided on it so that the coin holder can be worn as a broach. Further still, the coin holder is adapted to have removably affixed to it a leg or the like so that it can be seated on a support surface with the coin supported in a substantially upright position, in much the same fashion as a picture would be displayed within a picture frame. Further still, the coin holder can be adapted for hanging on a wall to display the coin retained therein.

Accordingly, it is an object of the present invention to provide a coin holder for interchangeably receiving and displaying respective ones of a number of substantially like-size coins.

The above objective is accomplished with the coin holder of the present invention which generally includes a decorative backing member of a pre-established configuration having on one face thereof a raised annular rim which is of a diameter and height substantially corresponding to the diameter and thickness of one of the coins which is to be received and displayed within the coin holder. The backing member can assume any one of a number of different configurations so as to, for example, constitute a piece of jewelry. An annular locking ring is removably secured to the backing member to secure the coin within the annular rim. Being removably secured to the backing member, the annular locking ring can be removed and the respective ones of the coins can be interchangeably received and displayed within the coin holder. The back side of the backing member can be adapted to receive a chain so that the coin holder can be worn as a necklace or, alternatively, to receive a pin so that the coin holder can be affixed to the clothing so that the coin holder can be worn as a broach. Further still, a V-shaped leg or the like can be affixed to the back of the backing member so that the coin holder can be supported in a generally upright position on a support surface so that the coin holder generally functions as a picture frame or the like to display the coin disposed within it.

DESCRIPTION OF THE PREFERRED EMBODIMENT OF THE INVENTION

Figure 1:
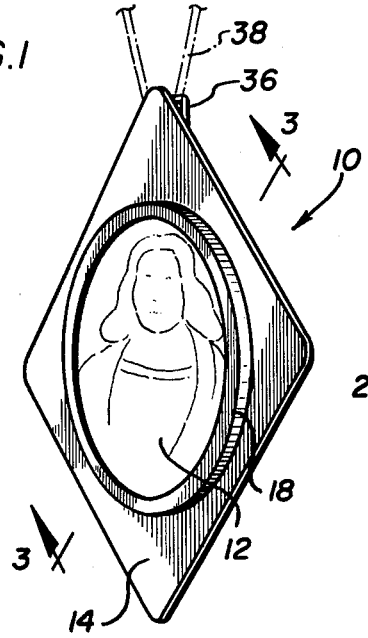
FIG. 1 is a perspective view of a coin holder exemplary of the invention.
Figure 2:
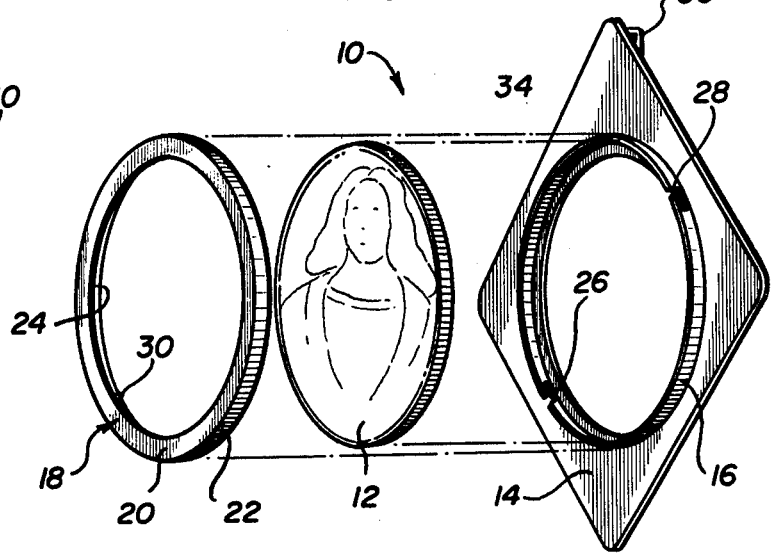
FIG. 2 is an exploded perspective view of the coin holder of FIG. 1.
Figure 3:
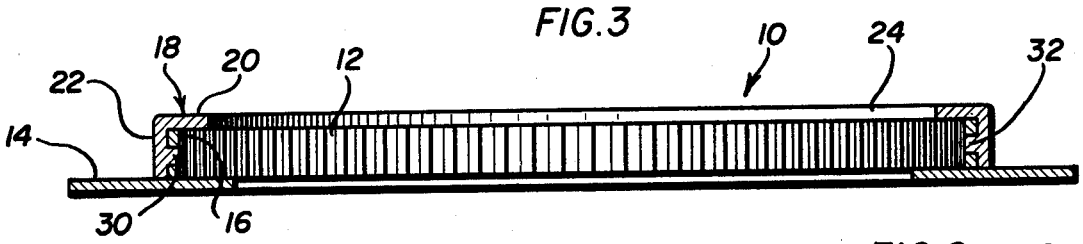
FIG. 3 is a sectional view taken along lines 3—3 of FIG. 1.

Referring now to the drawing, there is disclosed a coin holder 10 for interchangeably receiving and displaying respective ones of a plurality of substantially like-size coins, such as the coin 12. The coin holder 10 includes a decorative backing member 14 of a pre-established configuration which, in the illustrated embodiment, is shown to be of a generally rectangular configuration. On the front face of the decorative backing member 14 is a raised annular rim 16 secured to the backing member in any suitable fashion as by, for example, welding or soldering it thereto. The raised annular rim preferably and advantageously is of a diameter and height substantially corresponding to the diameter and thickness of one of the plurality of coins which is to be received and displayed within the coin holder 10.

An annular locking ring 18 having a top wall 20 and a side wall 22 is provided for securing the coin within the raised annular rim 16 on the backing member 14. The side wall 22 of the locking ring 18 has a height and a diameter substantially corresponding to the height and diameter of the annular rim 16 so that the annular ring 16 is received within the locking ring 18. The top wall 20 of the locking ring 18 has an opening 24 formed in it for permitting a coin disposed within the annular rim 16 to be visually observed when the locking ring 18 is secured to the backing member 14.

The locking ring 18 is removably secured to the backing member 14 so that the locking ring can be removed to removably replace a coin in the annular rim 16 on the backing member 14. This locking ring 18 can be removably secured to the backing member 14 in any one of a number of different manners. For example, the annular rim 16 and the side wall 22 of the locking ring 18 can be provided with complimentary interlocking means. As illustrated, these interlocking means may comprise a pair of generally L-shaped locking slots 26 and 28 formed in the annular rim 16 in diametrically opposed positions, and a pair of pins 30 and 32 affixed to the side wall 22 of the locking ring 18, with these pins 30 and 32 being positioned and proportioned to be received within the respective ones of the locking slots 26 and 28 to removably secure the locking ring 18 to the annular rim 16. In affixing the annular locking ring 18 to the annular rim 14, the locking ring 18 is positioned with the respective pins 30 and 32 disposed within the vertical leg of the locking slots 26 and 28, the locking ring 18 pressed downwardly and then rotated to engage the pins 30 and 32 in the horizontal legs of the respective locking slots 26 and 28 to lockingly engage the locking ring 18 to the backing member 14. Other similar types of complimentary interlocking means can be provided on the locking ring 18 and the annular rim 16 of the backing member 14. Further still, the annular rim 16 and the locking ring 18 can be formed with complimentary threads so that the locking ring 18 is removably threaded to the backing member 14.

The backing member 14 and the locking ring 18 preferably and advantageously can be formed of a precious or semi-precious metal, such as gold, silver or stainless steel, or it can be gold-plated or silver-plated, so that the coin holder effectively constitutes a piece of jewelry, when a coin is removably disposed within it. As indicated above, the backing member 14 can assume any one of a number of decorative configurations and obviously is not limited to the rectangular configuration as illustrated.

In removably placing a coin in the coin holder 10, the locking ring 18 is first removed, a coin is then disposed within the annular rim 16, and the locking ring then is removably lockingly engaged with the backing member 14. The coin disposed within the annular rim 16 can be visually observed through the opening 24 in the top wall 20 of the locking ring 18.

In many cases, commemorative coins and the like which may be displayed within the coin holder 18 have various inscriptions and information regarding the coin on the back side thereof rendering the significance of the coin displayed within the coin holder 10 more apparent to the owner thereof. Accordingly, the backing member 14 preferably and advantageously can be provided with an opening 34 which permits this information on the back side of the coin disposed within the coin holder 10 to be observed and read.

Figure 4:
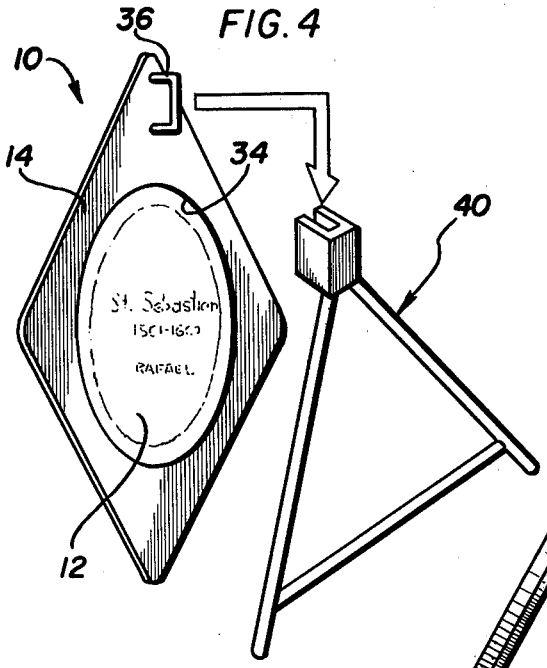
FIG. 4 is a perspective view of the coin holder illustrating the manner in which it can be adapted to function essentially as a picture frame.
Figure 5:
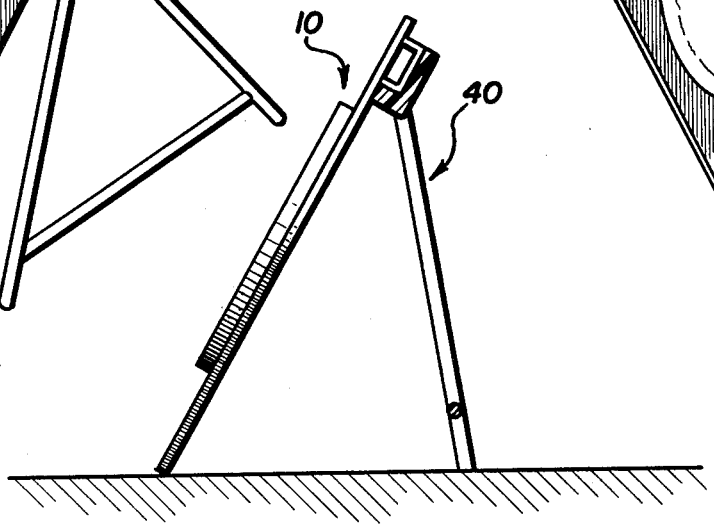
FIG. 5 is a side plan view of the coin holder of FIG. 4.
Figure 6:
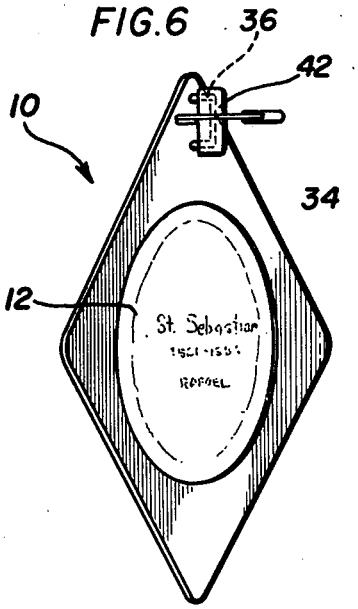
FIG. 6 is a rear perspective view of the coin holder illustrating the manner in which it can be adapted to function essentially as a broach.

As illustrated in FIGS. 1 and 4, the back side of the backing member 14 can be provided with a loop 36 or the like, for receiving therein a chain 38 so that the coin holder 10 can be worn about the neck of a party as a necklace. Further still, as illustrated in FIGS. 4 and 5, a generally triangular-shaped leg member 40 can be adapted to be removably affixed to the loop 36 so that the coin holder can be seated and supported in a generally vertical upright position on a book shelf or the like so that the coin holder can function as a picture frame or the like to display a coin disposed therein. Further still, as illustrated in FIG. 6, a pin or the like 42 can be adapted to be affixed to the loop 36 on the back side of the backing member 14 so that the coin holder 10 can be pinned to the clothing of a person to be worn as a broach or the like.

It is also obvious that various other configurations of the coin holder 10 can be provided. For example, a threaded screw or the like can be provided with the leg member 40 to more securely affix the latter to the coin holder 10 so that a more stable construction is provided. Further still, a substantially larger coin holder can be provided having, for example, provisions for removably securing therein a series of coins so that a whole set of coins can be attractively displayed in a single unit. In such a case, it would most likely be adapted for a wall mounting, or for seating on a support surface, for use in the fashion of a picture frame. It is also contemplated that a disc of plastic, glass or the like can be used to effectively seal or protect a coin disposed in the coin holder 10, the same obviously being placed over the face of the coin and retained in position by the locking ring. A similar disc can be used to close the opening in the back of the coin holder 10, or alternatively, the opening can be eliminated. It is also contemplated that such an arrangement can be used as a picture frame to display a snapshot or the like.

It will thus be seen that the objects set forth above, among those made apparent from the preceding description, are efficiently attained and certain changes may be made in the above article. Accordingly, it is intended that all matter contained in the above description or shown in the accompanying drawing shall be interpreted as illustrative and not in a limiting sense.

Now that the invention has been described, what is claimed as new and desired to be secured by Letters Patent is:

1. A coin holder for interchangeably receiving and displaying respective ones of a plurality of substantially like-size coins comprising:

a decorative backing member of a pre-established configuration having on one face thereof a raised annular rim which is of a diameter and height substantially corresponding to the diameter and thickness of one of said coins, whereby said coin is removably retained therein;

an annular locking ring having a top wall and a side wall, said side wall having a height and a diameter substantially corresponding to the height and diameter of said annular rim for receiving the latter therein, said top wall extending inwardly from said annular rim so as to secure a coin within said annular rim and having an opening therein for permitting a coin disposed within said annular rim to be visually observed when said locking ring is secured to said annular rim; and complimentary interlocking means on said annular rim and said side wall of said locking ring for removably securing said locking ring to said annular rim, said complimentary interlocking means comprising a pair of generally L-shaped locking slots formed in one of said annular rim and said locking ring in diametrically opposed positions and a pair of locking pins on the other one of said annular rim and said locking ring proportioned and positioned to lockingly engage within the respective ones of said locking slots, said locking pins being engaged by downwardly disposing said locking pins on one leg of said locking slots until said locking ring can be angularly rotated to engage said locking pins in the other leg of said locking slots and the angularly rotating said locking ring.

2. The coin holder of claim 1, further comprising means removably affixed to said backing member for permitting said coin holder to be worn about the neck of a person, whereby said coin holder can be worn as a necklace.

3. The coin holder of claim 1, further comprising means removably affixed to said back member for permitting said coin holder to be supported in a substantially upright position on a support surface, whereby said coin holder can function as a picture frame or the like to display a coin disposed therein.

4. The coin holder of claim 1, further comprising attachment means secured to said backing member, means removably securable to said attachment means for permitting said coin holder to be worn about the neck of a person, and means removably securable to said attachment means for permitting said coin holder to be supported in a substantially upright position on a surface, whereby said coin holder can be selectively worn as a necklace and used as a picture frame or the like to display a coin disposed therein.

5. The coin holder of claim 1, wherein said pair of L-shaped locking slots are provided in said annular rim and said locking pins are on said locking ring, whereby said locking slots are concealed when said locking ring is secured to said annular rim.

6. The coin holder of claim 1, wherein said backing member and said locking ring are of a metallic material.

* * * * *